US006695890B1

(12) United States Patent
Hazel et al.

(10) Patent No.: US 6,695,890 B1
(45) Date of Patent: Feb. 24, 2004

(54) FUEL COMPOSITION

(75) Inventors: Clifford James Hazel, Hessenford (GB); Ian Vernon Williamson, Cheadle (GB)

(73) Assignee: AAE Technologies International plc, Cork (IE)

( * ) Notice: Subject to any disclaimer, the term of this patent is extended or adjusted under 35 U.S.C. 154(b) by 0 days.

(21) Appl. No.: 09/848,610

(22) Filed: May 3, 2001

(Under 37 CFR 1.47)

Related U.S. Application Data

(63) Continuation of application No. 09/637,299, filed on Aug. 11, 2000, now abandoned, which is a continuation of application No. 09/459,789, filed on Dec. 13, 1999, now abandoned, which is a continuation of application No. 09/294,827, filed on Apr. 19, 1999, now abandoned, which is a continuation of application No. PCT/GB97/02763, filed on Oct. 20, 1997.

(30) Foreign Application Priority Data

Oct. 18, 1996 (GB) ..... 9621753

(51) Int. Cl.[7] ..... C10L 1/18; C10L 1/22
(52) U.S. Cl. ..... 44/385; 44/418; 44/443
(58) Field of Search ..... 44/385, 418, 443

(56) References Cited

U.S. PATENT DOCUMENTS 6,183,524 B1 * 2/2001 Ahmed ..... 44/385

FOREIGN PATENT DOCUMENTS

GB 2217229 A * 10/1989

* cited by examiner

*Primary Examiner*—Cephia D. Toomer
(74) *Attorney, Agent, or Firm*—Darby & Darby

(57) ABSTRACT

A fuel composition for a combustion engine that is treated with a hybrid molecule that is balanced into a polymer by ethoxylation, the result being a commercially viable fuel that is delivered to the point of combustion in the best possible condition with least resistance.

55 Claims, 11 Drawing Sheets

Stabilizer Chart (Di)

Comparison Results on "Mercedes MIII"

Maximum Benefit - 1,800 r.p.m. PT

Comparison Results on "Mercedes MIII"

Maximum Benefit - 2,500 r.p.m. PT

Comparison Results on "Mercedes MIII"

Comparison Results on "Mercedes MIII"

Comparison Smoke Test on Ford Diesel 1.8 Engine

Overall Reduction 66%

FUEL COMPOSITION

This application is a CON of 09/637,299 Aug. 11, 2000 ABN which is a CON of 09/459,789 Dec. 13, 1999 ABN which is a CON of 09/294,827 Apr. 19, 1999 ABN, which is a CON of PCT/GB/97/02763 Oct. 20, 1997.

The invention relates to a fuel composition and in particular to such a liquid composition to be burned in an engine such as an internal combustion engine, e.g. a petrol or Diesel engine or any engines designed to perform with liquid fuels.

It is well known that liquid fuels when burned in an internal combustion engine can give rise to pollution and other undesired side effects. Numerous proposals have been advanced to reduce these side effects and enhance efficiency, e.g. miles per gallon. It has been realised that surfactants can play a useful role in this context but so far as we are aware none has satisfied the modern commercial criteria. It is one object of this invention to meet the need.

In one aspect the invention proves a fuel composition including a fuel miscible additive selected to solubilise the fuel and the additive and any water present to form a clear homogenous composition.

The preferred additive of this invention is a non-ionic surfactant and preferably a blend of surfactants. It is a preferred feature of this invention that the surfactants be selected by their nature and concentration that the additive (as well as any water or other non-fuel liquid present) be solubilised within the fuel. For this purpose it is convenient to have regard to the hydrophilic-lipophilic (HLB) of the surfactant, the value being calculated according to the expression.

$$HLB = \frac{\text{mol. wt of hydrophilic chain} \times 20}{\text{total mol. wt}}$$

The values will depend on the length of the hydrophilic chain, typically an ethoxylate chain. The length of the chain will increase the extent of solubilisation because of a greater ability to solubilise.

Normally a blend of surfactants is preferred, preferably by selecting one appropriate to the fuel, say 10 to 18 for hydrocarbon fuel, most preferably 13. In the case of an alcohol the HLB value of the surfactant is between 3 and 7, most preferably about 4. But the addition of surfactants normally create ratios of 1:1 or high volume emulsions or 5:1 ratios when the solubalisation is required at 1:100.

The invention has the ability to unify the HLB requirements of any liquid fuel which in turn allows for one dose to be used in any fuel from C5 carbon chains up. The benefit being the amount of treatment directly related to the co-solvency ability (as per enclosed charts). The charts show three different combinations of additive allowing a cost comparison to performance requirements.

The monolayer aspect of the invention requires the concentration of the additive to be very low, typically of the order of 0.5–1:1000, preferably about 1:1000, most preferably 1:1200 there appears to be no technical or economic benefit in adding more unless a co-solvent duel action is required, when the priority will be dosage against performance.

The additive preferably comprises of the following:

an oil soluble ethoxylated alcohol a super diethanolamide a 7 chain ethoxylated fatty acid The three ingredients must be added as per fuel and molecule production process.

Preferably the ethoxylate of the fatty acid makes up about 25% by volume of the additive and further preferably the alcohol ethoxylate comprises 50% by volume of the additive.

An additive of the invention may be added to a hydrocarbon fuel, e.g. Diesel or petrol or alcohol which may or may not be contaminated with water. The invention is seen to particularly good effect when added to synthetic fuels based on low fraction oils.

In another aspect the invention provides a fuel composition comprising a light weight fraction and including an additive miscible with the fuel selected to solubilise the fuel and the additive and any water present to form a clear homogenous composition.

The presence of the additive of the invention ensures that the fuel composition forms a consistent stable homogenous composition and creates a monolayer simoultenously a result of which leads to a better more complete burn which reduces pollution and increases miles per gallon.

As a result a blended fuel, particularly alcohol based, is able to combust more precisely with a cooler charge to reduce the iron-formates present form the aldehyde peracids and peroxide reactions normally attributable to engine degredation.

In another aspect the invention provides a method of forming a stable composition comprising adding the three specified ingredients, e.g. as an additive as defined to a fuel in a volume ratio of about 0.5–1:1000. Preferably the addition ratio is about 1:1000, most preferably about 1:1200.

A method of running an engine adapted to use a alcohol-based fuel, comprising adding to the fuel a miscible additive selected to solubilise the fuel and the additive so eliminating the deposit of by-products formed during the combustion of the fuel.

Fuel Production Process

1. Check water contamination by Karl Fischer and estimate volume of $H_2O$ in enduser tank.
2. Select from Stabiliser Charts the correct formula taking into consideration costs and treatment ratios.
3. When percentage of stabiliser is assessed blend necessary components as per chart and dose accordingly blending the molecule into the fuel and not mixing it.

Molecule Production Process

1. After correct selection of Super Amide blend at P.I.T. (Phase Inverse Tension) (55–58° C.) the Alcohol, the Ethylene Oxide.
2. Blend 1 with the *Super Amide Chosen at P.I.T.
3. Blend Fatty Acid with Ethylene Oxide and blend with 2 at P.I.T.
4. Resulting in a total blend of Alcohol Ethoxylate. Which must at least be 50% of the total weight of the molecule with equal parts of Super Amide and Fatty Acid Ethoxylate to achieve 100%.*

*Super Amide MUST be blended with either Fatty Acid Ethoxylate or Alcohol Ethoxylate

*Although a 50/25/25 blend in theory may not be the correct balance for a polymer, margins have to be taken into consideration for alien components such as Free Amines, Free PEG's, Free Esters and Isomers which are all present during this process. The molecular weight of the two tails invariably balance at this procedure.

Although the example stock solution is suitable for minimal water contamination problems the preferred alcohol ethoxylate will be straight chained primary linear and 3 mols of EO per.mol of alcohol as the precision in calculation is much more precise and the absorbant powers of the micelle is increased with the extra additions of ethoxylates. The primary and linear alcohol must be a minimum of 80% w/w as the balance of predominantly isomers are considered a contaminant and not helpful to the ethoxylation process.

The diethonanolimide should be a super amide which is identifyable as having a ratio of 1:1 fatty acid to diethanolamine as the 2:1 ratio contain 10% free amine esters and the nature of process allows this contamination which is not helpfull to the balancing of the polymer.

The fatty acid is preferably a C14 acid and is not manufactured by polyethylene glycol method as the free PEGS inhibit the ethoxylation process and upset the HLB balance.

In order that the invention may be well understood it will now be described by way of illustration only with reference to the following example.

EXAMPLE I

| | |
|---|---|
| oil soluble primary alcohol ethoxylate (mean 2.75 mols ethylene oxide; mol alcohol) available as NEODOL 91/2.5, predominatley $C_9$–$C_{11}$; mol. wt about 270 | 1 liter |
| lauric diethanolamide | 500 ml |
| a fatty acid with 7 ethoxylates per mol of fatty acid (available as ATLAS G5507) mol. wt about 506 | 500 ml |

The stock was heated to 55 to 58° C. as per the diagram to form a 2 liter stock solution.

Different used vehicles, having Diesel and petrol engines, were tested at a local Ministry of Transport test house. The fuel tank of each was filled, and the vehicle driven for about 112 Km at an average speed of 96 Kph. A dose of the stock solution was added to the tank of each vehicle in a volume ratio of 1:1000. Visual inspection showed that a clear homogeneous solution was formed. The tank was refilled and the vehicle then driven again over the same journey. The MOT test was repeated.

The results showed a decrease in fuel consumption ranging from 11 to 20%, the greater savings being obtained in the case of the larger sized engines.

The tests showed the following reductions in emissions:

Petrol Engine

CO reduced by a mean 80% hydrocarbon reduced by a mean 40%

Diesel engine

Diesel smoke reduction by a mean 50%

EXAMPLE II

A Mercedes M111 basic test engine was cleaned and prepared for testing to record any changes in reference gasoline without additive and with additive at a treatment rate of 1:1000.

The standard methods of measurement were used in accordance with NAMAS specifications, particular interest was paid to LAMBDA as the leaning/richening of the engine would not encourage comparable results. LAMBDA was set at 1=0.05.

The basic test was started and the engine was run hot and then dropped from 4,500 r.p.m. WOT to 1,800 r.p.m. PT stopping at different conditions to enable comparisons. LAMBDA performed at 1=0.05. At the end of the first test the head was cleaned and once again the test was repeated with additive at 1:1,000. $CO_2$ was reduced on average by 14.08% at 2,500 rpm PT and 20.64% Maximum.

EXAMPLE III

A Bench Test was carried out under controlled laboratory conditions to ascertain Fuel Consumption and Emission Performance at 1,800 r.p.m. and 2,500 r.p.m. part throttle and also measuring Power Curve and Torque Curve Performance, using RF83 reference European non-additised fuel, with all measurements recorded to NAMAS Criteria. The engine was a MERCEDES 2 liter M111 Bench Engine suitable for unleaded fuel, fitted with a Catalytic Converter. (All figures quoted are on measurements prior to Catalytic Converter). The results showed CO reduced on average by 11.3% at 2,500 r.p.m. PT and 14.34% Maximum.

EXAMPLE IV

A test was carried out to measure any reduction in Nox as Nox is directly related to combustionability and is a hazard that is impossible to negate in engines as Air/Fuel Ratio will always contain Nitrogen. The results showed that Nox reduced on average by 38.2% at 2,500 r.p.m. PT and 39% Maximum.

There are three ways to reduce Nox:

a) The less air the less nitrogen b) The lower the temperature of the charge the less Nox c) The better the delivery of fuel the less Nox.

BRIEF DESCRIPTION OF THE DRAWINGS

Attached are graphs 1–12 showing the beneficial effect of adding the additives of the present invention.

Power Curve shows a power curve measuring within repeatability the same power with less fuel and less air which reduces CO2 and Nox.

Figure 1:
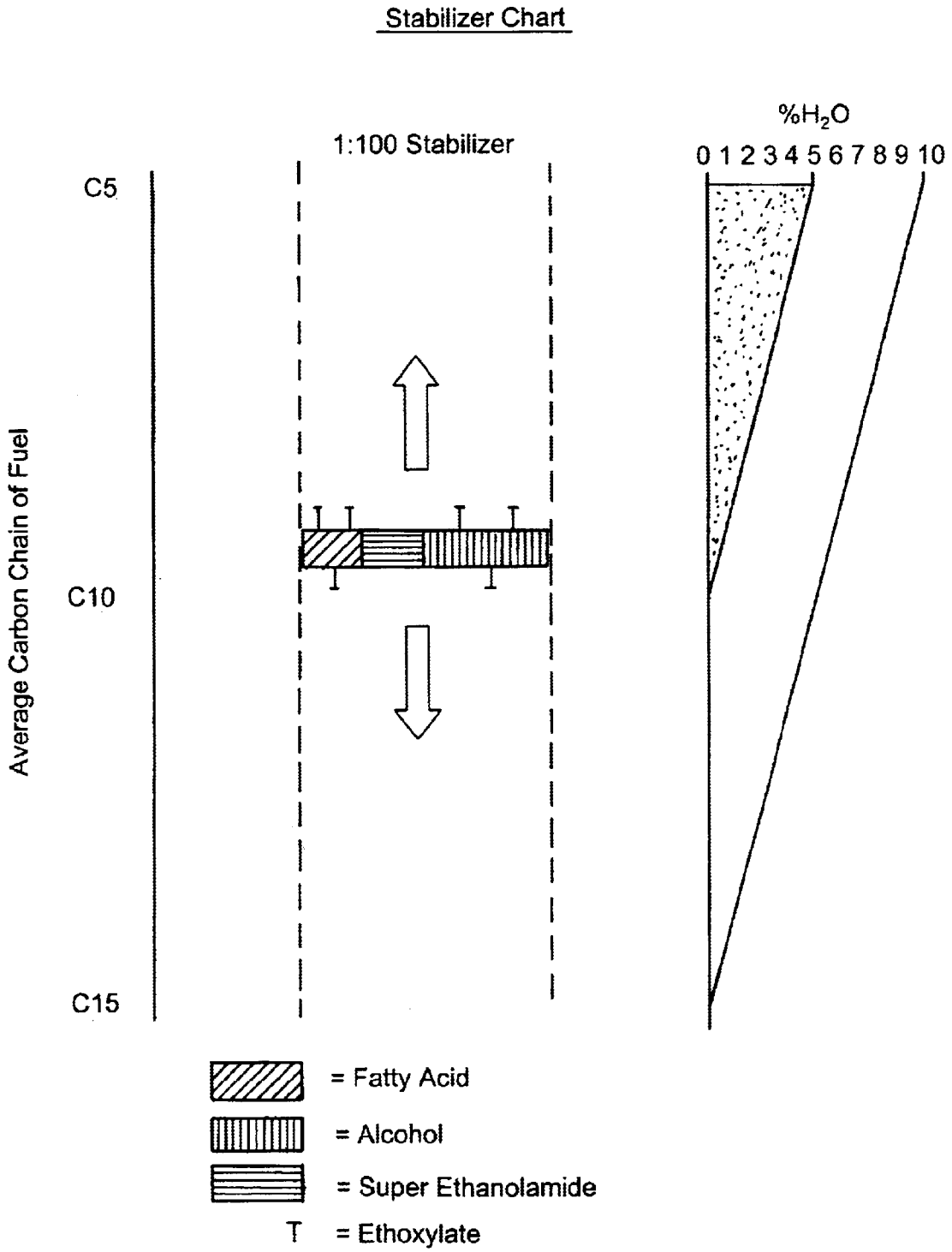
Figure 2:
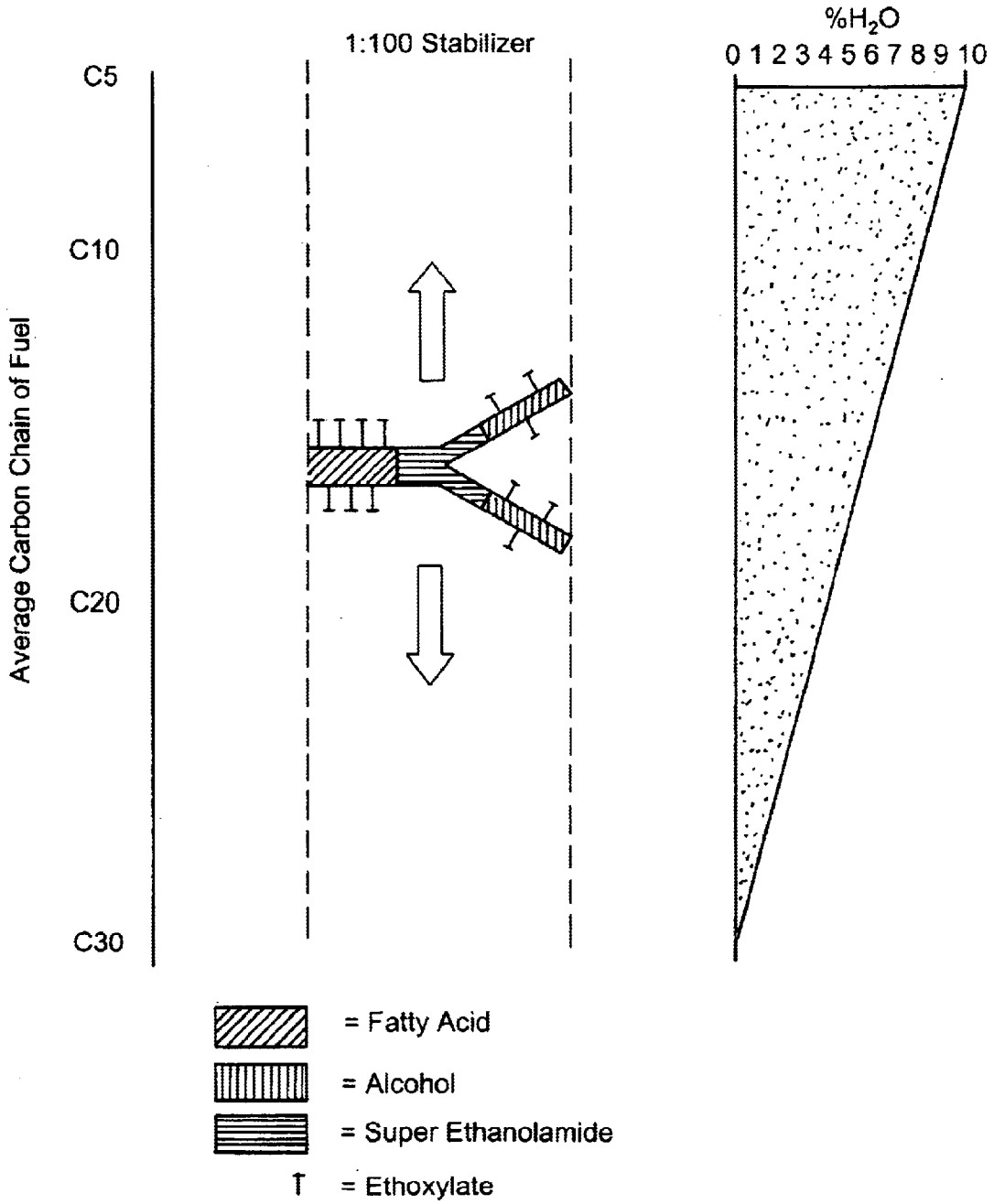
Figure 3:
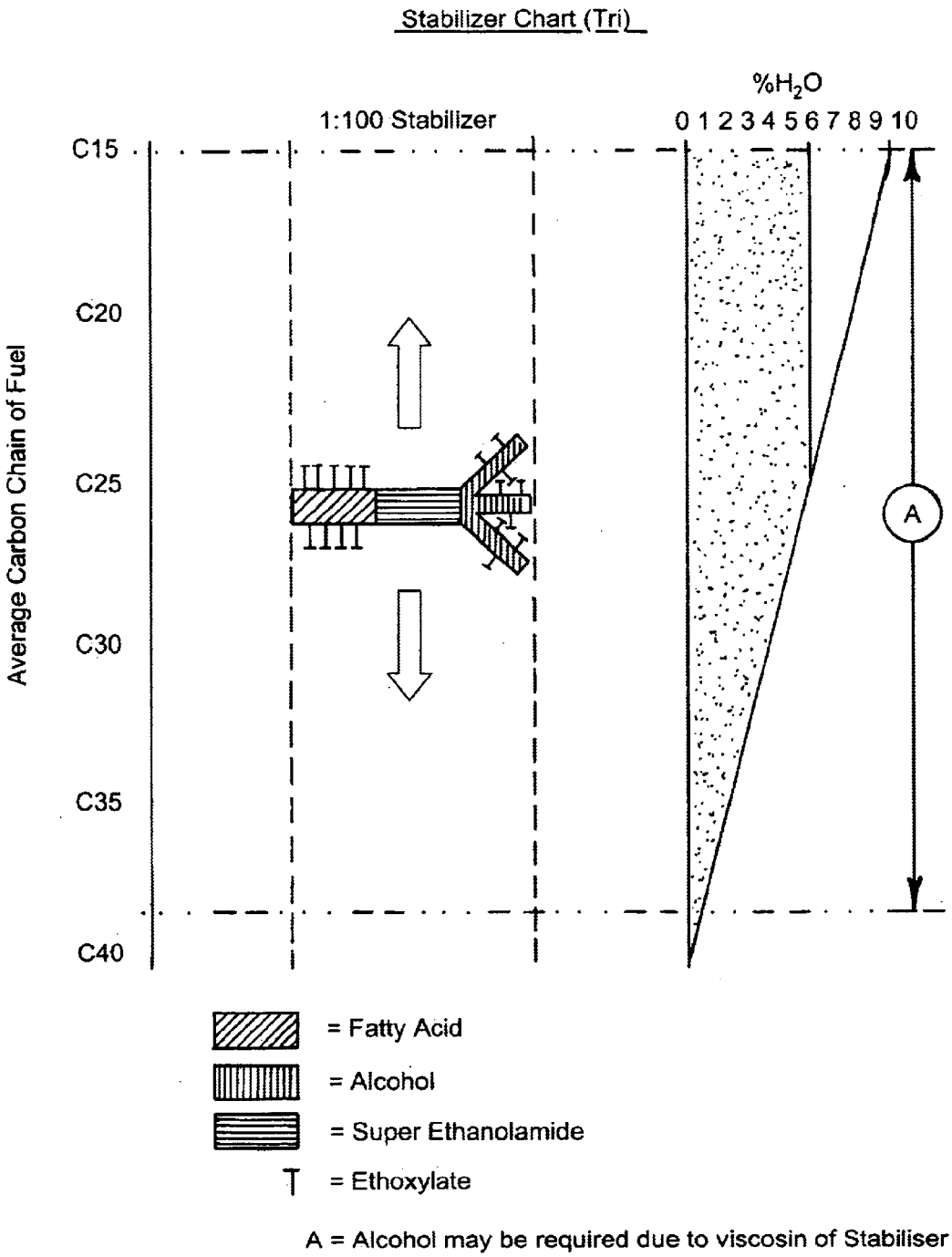
Figure 4:
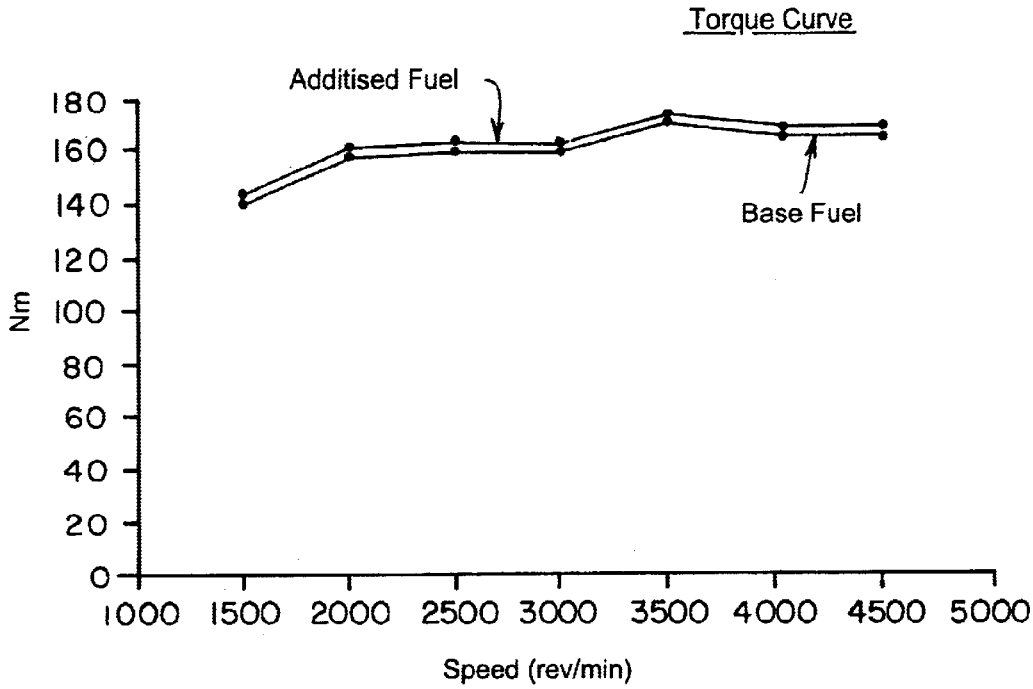
Figure 5:
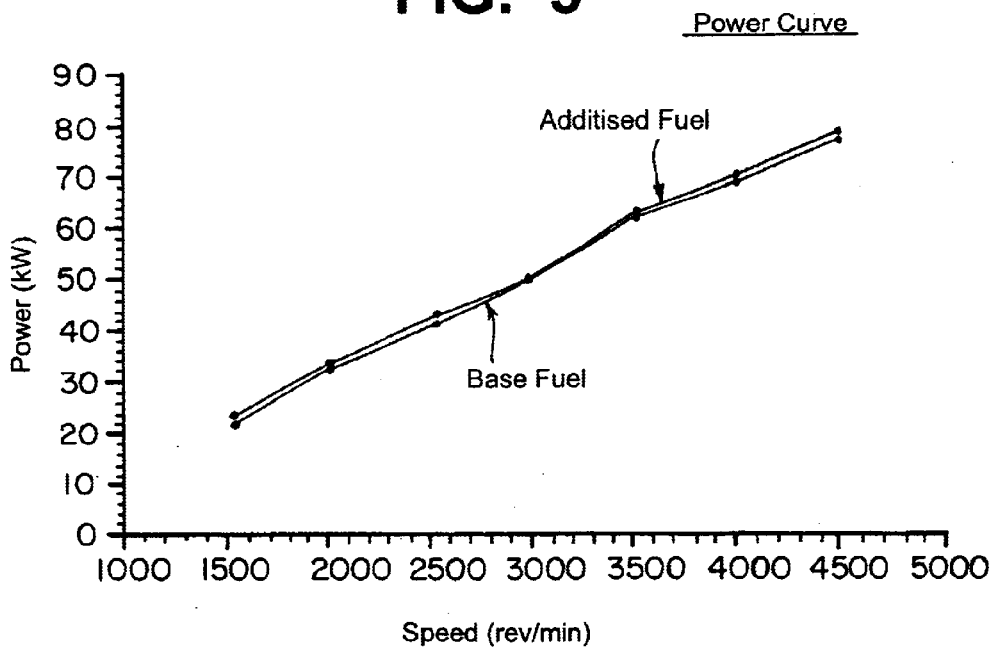
Figure 6:
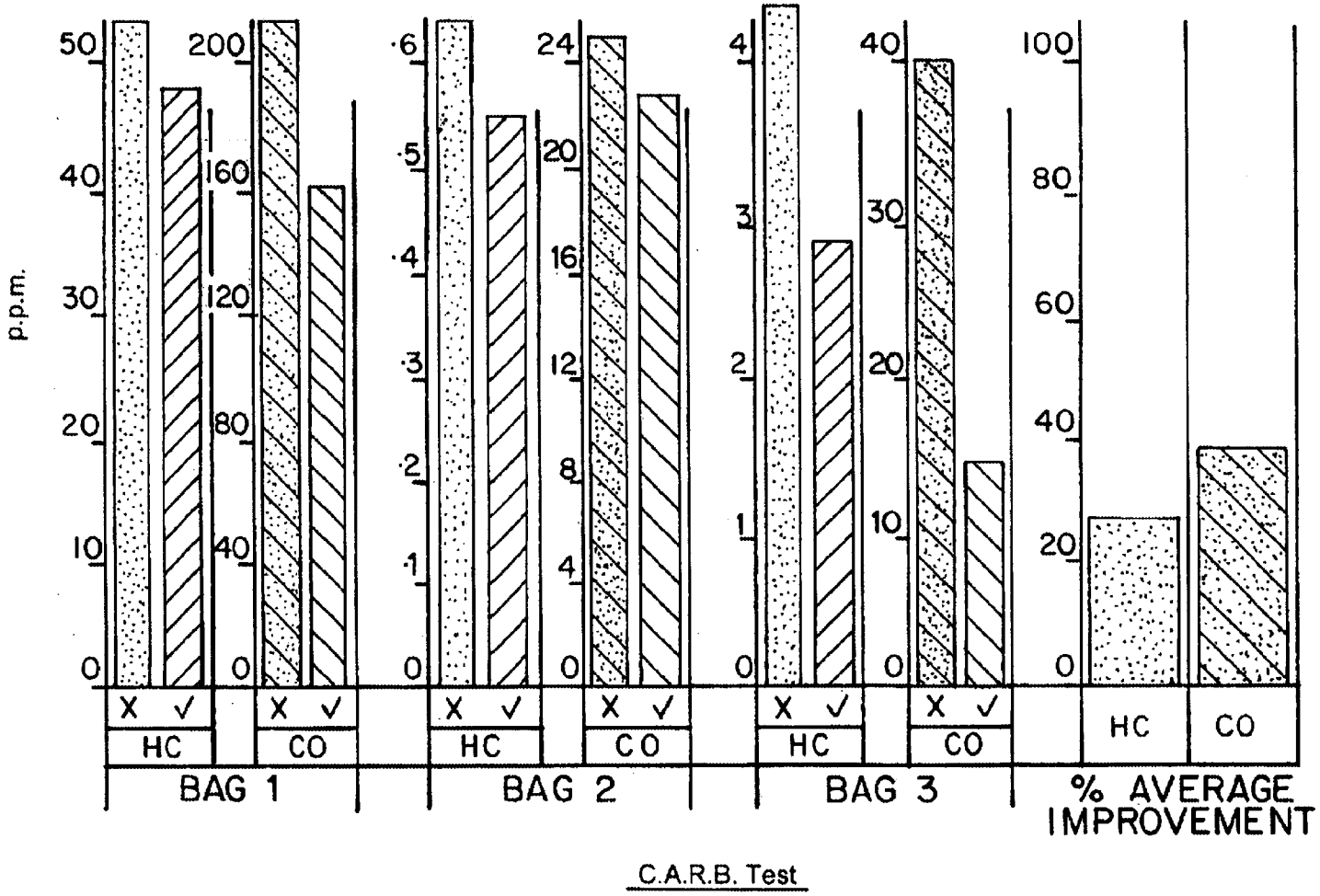
Figure 7:
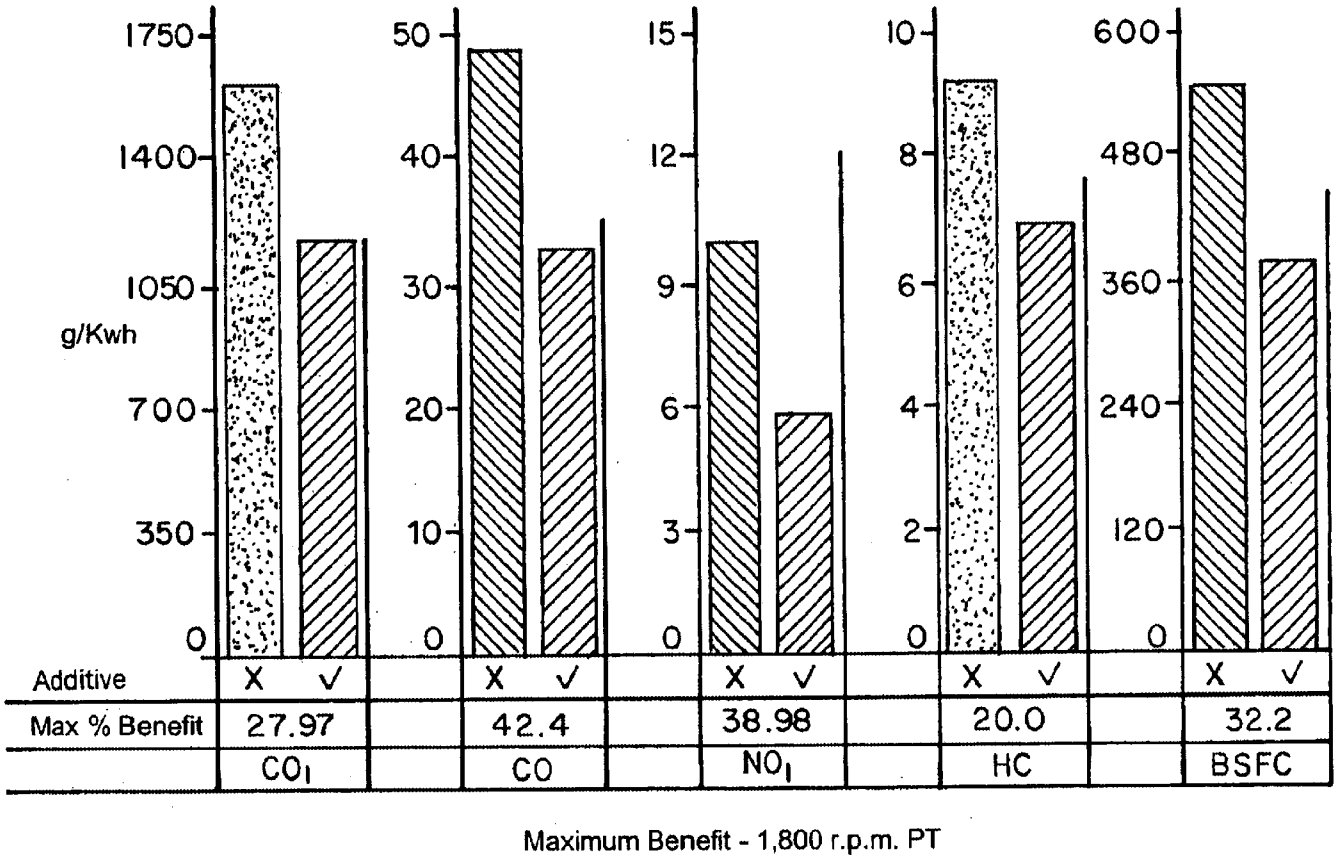
Figure 8:
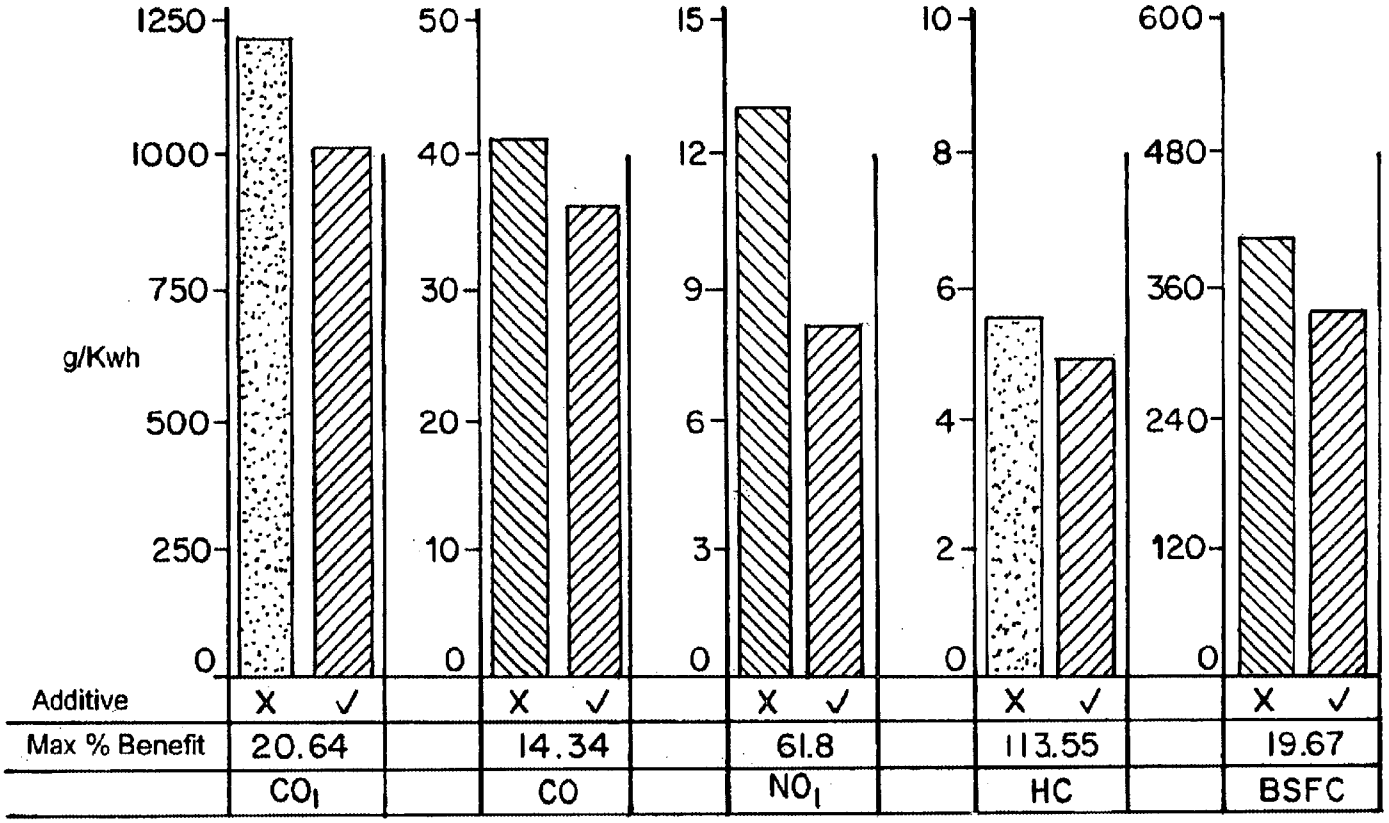
Figure 9:
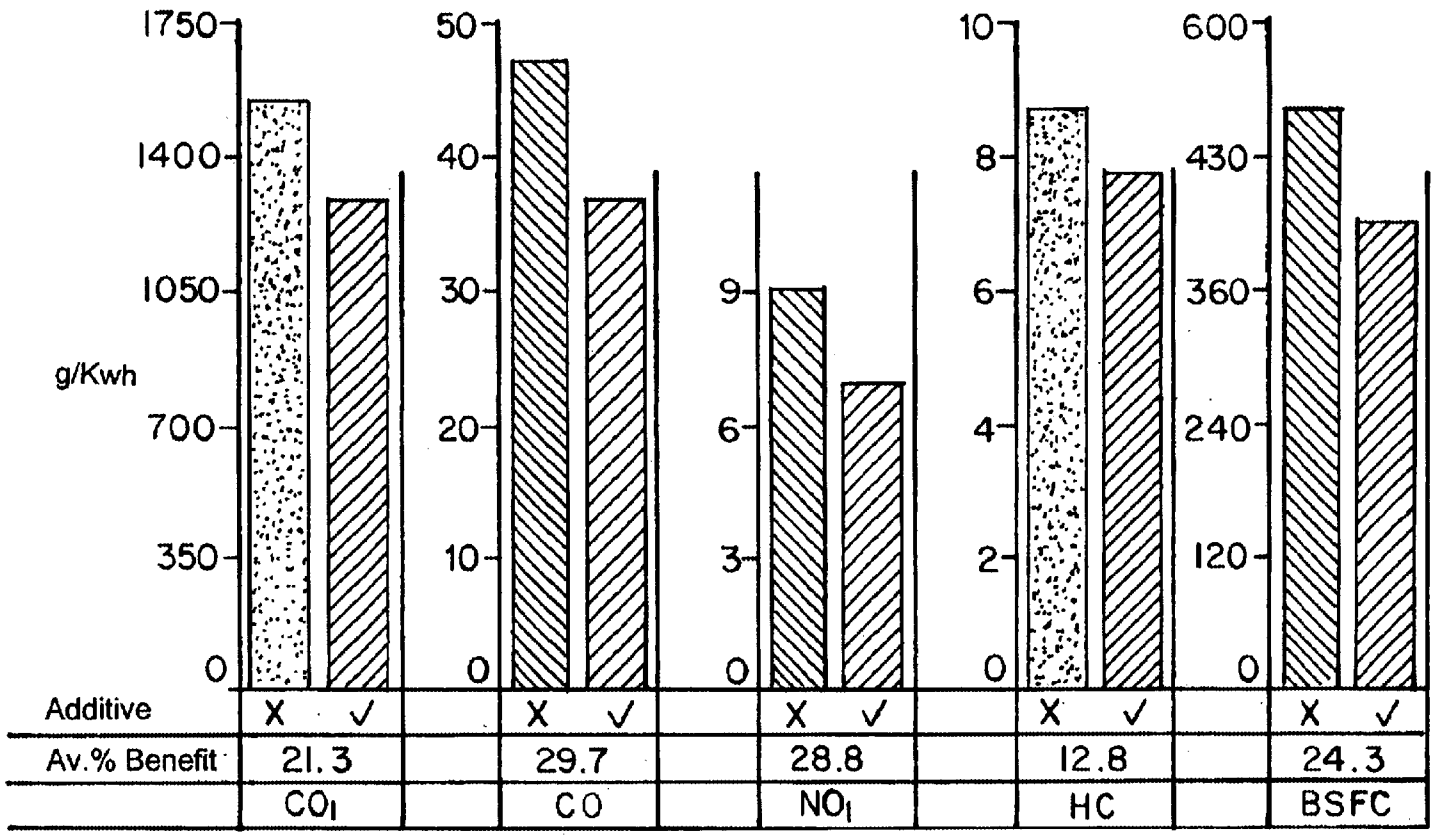
Figure 10:
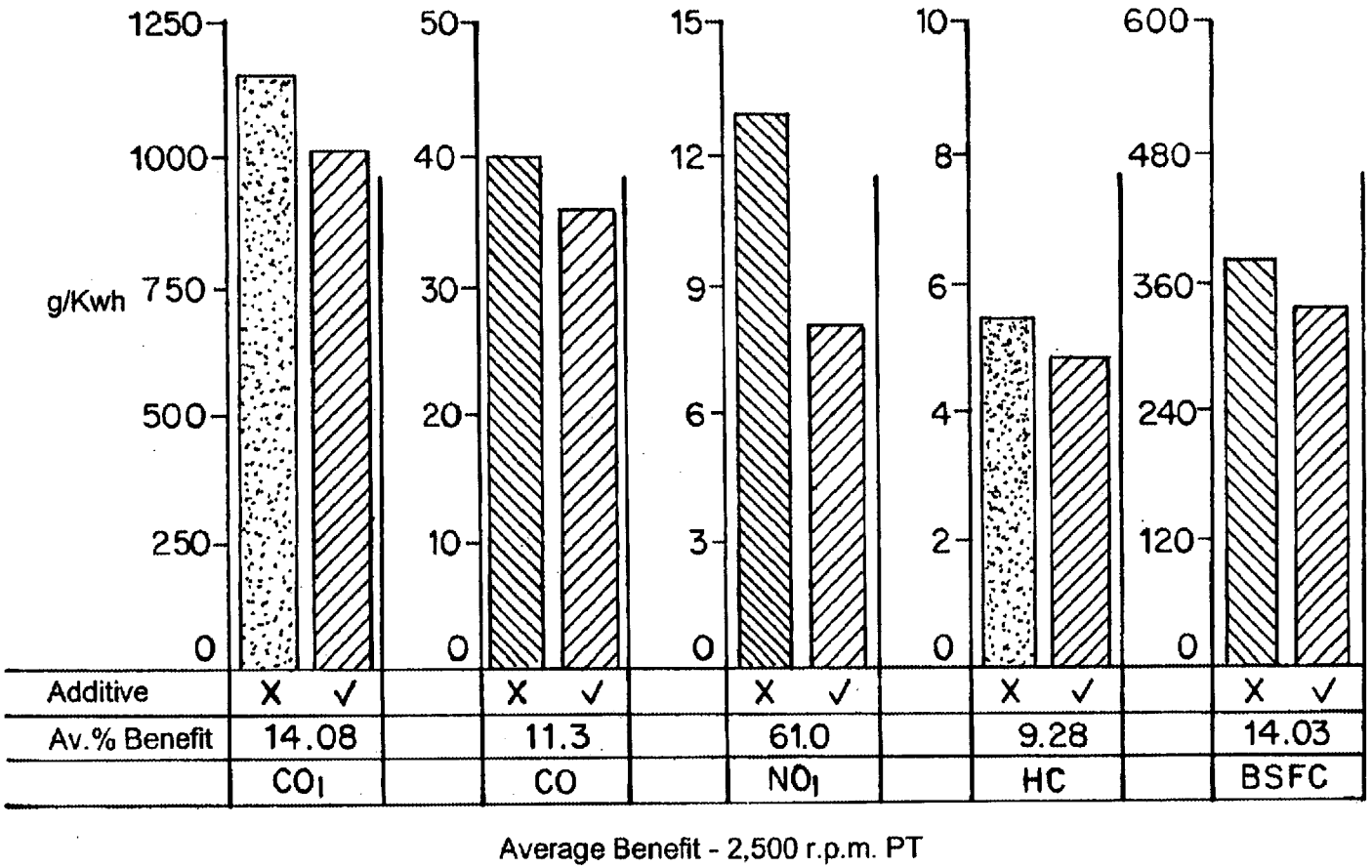
Figure 11:
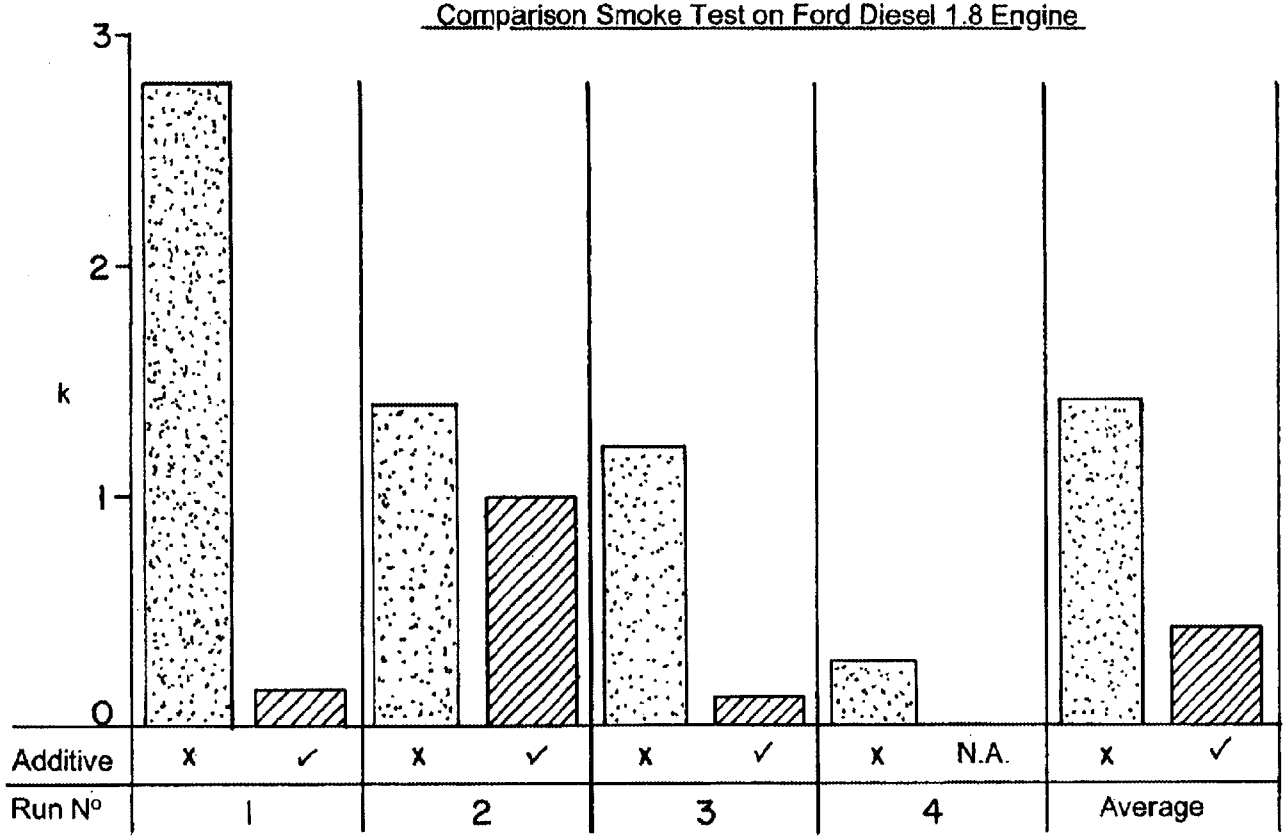
Figure 12:
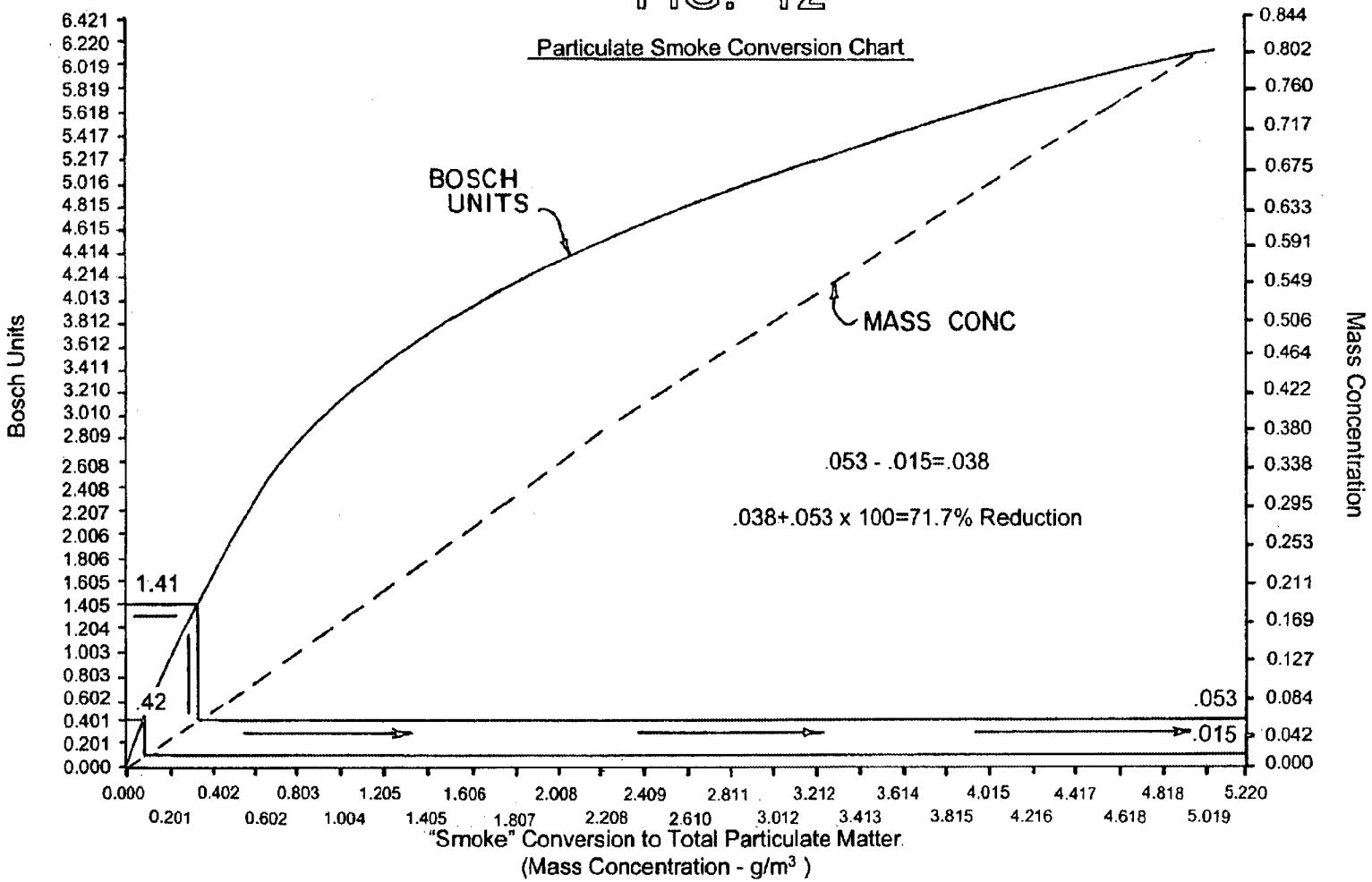

Torque Curve shows a torque curve measuring within repeatability the same power with less fuel and less air which reduces CO2 and Nox.

Co-Solvency Tests

Examples

A specific variety of fuels from premium grade gasoline, industry standard diesel and various alcohol blended fuels were selected and from each 100 ml were transferred to each of twelve 200 ml measuring cylinders for reference to the phase separation caused by saturation of water to the polymer. The optimal being two titrations previous to the phase.

Example 1.

| Fuel | No | Water Content | Additive | Comments |
|---|---|---|---|---|
| Gasoline | 1 | 0% | 0% | Clear Liquid |
| Gasoline | 2 | 10% | 0% | Phase separation |
| Gasoline | 3 | 10% | 10% | Clear Liquid |
| Gasoline | 4 | 10% | 9% | Clear Liquid |
| Gasoline | 5 | 10% | 8% | Clear Liquid |
| Gasoline | 6 | 10% | 7% | Clear Liquid |
| Gasoline | 7 | 10% | 6% | Clear Liquid |
| Gasoline | 8 | 10% | 5% | Clear Liquid |
| Gasoline | 9 | 10% | 4% | Phase Separation |
| Gasoline | 10 | 10% | 3% | Phase Separation |
| Gasoline | 11 | 10% | 2% | Phase Separation |
| Gasoline | 12 | 10% | 1% | Phase Separation |

After the introduction of each titration the solution was gently stirred for twenty seconds. The resultant effect was left for ten minutes to settle before visible results were recorded.

Example 2.—Gasohol

Consisting of 90% regular unleaded gasoline with 10% denatured ethanol

| Fuel | No | Water Content | Additive | Comments |
|---|---|---|---|---|
| Gasohol | 1 | 0% | 0% | Clear Liquid |
| Gasohol | 2 | 10% | 0% | Phase separation |
| Gasohol | 3 | 10% | 10% | Clear Liquid |
| Gasohol | 4 | 10% | 9% | Clear Liquid |
| Gasohol | 5 | 10% | 8% | Clear Liquid |
| Gasohol | 6 | 10% | 7% | Clear Liquid |
| Gasohol | 7 | 10% | 6% | Clear Liquid |
| Gasohol | 8 | 10% | 5% | Clear Liquid |
| Gasohol | 9 | 10% | 4% | Clear Liquid |
| Gasohol | 10 | 10% | 3% | Phase Separation |
| Gasohol | 11 | 10% | 2% | Phase Separation |
| Gasohol | 12 | 10% | 1% | Phase Separation |

After the introduction of each titration the solution was gently stirred for twenty seconds. The resultant effect was left for ten minutes to settle before visible results were recorded.

Example 3.—Diesel

| Fuel | No | Water Content | Additive | Comments |
|---|---|---|---|---|
| Diesel | 1 | 0% | 0% | Clear Liquid |
| Diesel | 2 | 10% | 0% | Phase separation |
| Diesel | 3 | 10% | 10% | Clear Liquid |
| Diesel | 4 | 10% | 9% | Clear Liquid |
| Diesel | 5 | 10% | 8% | Clear Liquid |
| Diesel | 6 | 10% | 7% | Phase Separation |
| Diesel | 7 | 10% | 6% | Phase Separation |
| Diesel | 8 | 10% | 5% | Phase Separation |
| Diesel | 9 | 10% | 4% | Phase Separation |
| Diesel | 10 | 10% | 3% | Phase Separation |
| Diesel | 11 | 10% | 2% | Phase Separation |
| Diesel | 12 | 10% | 1% | Phase Separation |

After the introduction of each titration the solution was gently stirred for twenty seconds. The resultant effect was left for ten minutes to settle before visible results were recorded.

Example 4.—Alternative Gasoline

Consisting of Alcohol and a blend of hydro carbons the majority percentage being alcohol

| Fuel | No | Water Content | Additive | Comments |
|---|---|---|---|---|
| Alt Gas | 1 | 0% | 0% | Clear Liquid |
| Alt Gas | 2 | 10% | 0% | Phase separation |
| Alt Gas | 3 | 10% | 10% | Clear Liquid |
| Alt Gas | 4 | 10% | 9% | Clear Liquid |
| Alt Gas | 5 | 10% | 8% | Clear Liquid |
| Alt Gas | 6 | 10% | 7% | Clear Liquid |
| Alt Gas | 7 | 10% | 6% | Clear Liquid |
| Alt Gas | 8 | 10% | 5% | Clear Liquid |
| Alt Gas | 9 | 10% | 4% | Clear Liquid |
| Alt Gas | 10 | 10% | 3% | Clear Liquid |
| Alt Gas | 11 | 10% | 2% | Phase Separation |
| Alt Gas | 12 | 10% | 1% | Phase Separation |

After the introduction of each titration the solution was gently stirred for twenty seconds. The resultant effect was left for ten minutes to settle before visible results were recorded.

Example 5.

| Fuel | No | Water Content | Additive | Comments |
|---|---|---|---|---|
| Gasoline | 1 | 0% | 0% | Clear Liquid |
| Gasoline | 2 | 5% | 0% | Phase separation |
| Gasoline | 3 | 5% | 5% | Clear Liquid |
| Gasoline | 4 | 5% | 4.5% | Clear Liquid |
| Gasoline | 5 | 5% | 4% | Clear Liquid |
| Gasoline | 6 | 5% | 3.5% | Clear Liquid |
| Gasoline | 7 | 5% | 3% | Clear Liquid |
| Gasoline | 8 | 5% | 2.5% | Clear Liquid |
| Gasoline | 9 | 5% | 2% | Phase Separation |
| Gasoline | 10 | 5% | 1.5% | Phase Separation |
| Gasoline | 11 | 5% | 1% | Phase Separation |
| Gasoline | 12 | 5% | 0.5% | Phase Separation |

After the introduction of each titration the solution was gently stirred for twenty seconds. The resultant effect was left for ten minutes to settle before visible results were recorded.

Example 6.—Gasohol

Consisting of 90% regular unleaded gasoline with 10% denatured ethanol

| Fuel | No | Water Content | Additive | Comments |
|---|---|---|---|---|
| Gasohol | 1 | 0% | 0% | Clear Liquid |
| Gasohol | 2 | 5% | 0% | Phase separation |
| Gasohol | 3 | 5% | 5% | Clear Liquid |
| Gasohol | 4 | 5% | 4.5% | Clear Liquid |
| Gasohol | 5 | 5% | 4% | Clear Liquid |
| Gasohol | 6 | 5% | 3.5% | Clear Liquid |
| Gasohol | 7 | 5% | 3% | Clear Liquid |
| Gasohol | 8 | 5% | 2.5% | Clear Liquid |
| Gasohol | 9 | 5% | 2% | Clear Liquid |
| Gasohol | 10 | 5% | 1.5% | Phase Separation |
| Gasohol | 11 | 5% | 1% | Phase Separation |
| Gasohol | 12 | 5% | 0.5% | Phase Separation |

After the introduction of each titration the solution was gently stirred for twenty seconds. The resultant effect was left for ten minutes to settle before visible results were recorded.

Example 7.—Diesel

| Fuel | No | Water Content | Additive | Comments |
|---|---|---|---|---|
| Diesel | 1 | 0% | 0% | Clear Liquid |
| Diesel | 2 | 5% | 0% | Phase separation |
| Diesel | 3 | 5% | 5% | Clear Liquid |
| Diesel | 4 | 5% | 4.5% | Clear Liquid |
| Diesel | 5 | 5% | 4% | Clear Liquid |
| Diesel | 6 | 5% | 3.5% | Phase Separation |
| Diesel | 7 | 5% | 3% | Phase Separation |
| Diesel | 8 | 5% | 2.5% | Phase Separation |
| Diesel | 9 | 5% | 2% | Phase Separation |
| Diesel | 10 | 5% | 1.5% | Phase Separation |
| Diesel | 11 | 5% | 1% | Phase Separation |
| Diesel | 12 | 5% | 0.5% | Phase Separation |

After the introduction of each titration the solution was gently stirred for twenty seconds. The resultant effect was left for ten minutes to settle before visible results were recorded.

Example 8.—Alternative Gasoline

Consisting of Alcohol and a blend of hydro carbons the majority percentage being alcohol

| Fuel | No | Water Content | Additive | Comments |
|---|---|---|---|---|
| Alt Gas | 1 | 0% | 0% | Clear Liquid |
| Alt Gas | 2 | 5% | 0% | Phase separation |
| Alt Gas | 3 | 5% | 5% | Clear Liquid |
| Alt Gas | 4 | 5% | 4.5% | Clear Liquid |
| Alt Gas | 5 | 5% | 4% | Clear Liquid |
| Alt Gas | 6 | 5% | 3.5% | Clear Liquid |
| Alt Gas | 7 | 5% | 3% | Clear Liquid |
| Alt Gas | 8 | 5% | 2.5% | Clear Liquid |
| Alt Gas | 9 | 5% | 2% | Clear Liquid |
| Alt Gas | 10 | 5% | 1.5% | Clear Liquid |
| Alt Gas | 11 | 5% | 1% | Phase Separation |
| Alt Gas | 12 | 5% | 0.5% | Phase Separation |

After the introduction of each titration the solution was gently stirred for twenty seconds. The resultant effect was left for ten minutes to settle before visible results were recorded.

To record the visual aspects of phase separation for the one percent water and 0.1 percent titrations it was decided to scale up the volumes tenfold to enable accurate readings, therefore 1 liter of each fuel was transferred to each of twelve 2 liter measuring cylinders.

Example 9.

| Fuel | No | Water Content | Additive | Comments |
|---|---|---|---|---|
| Gasoline | 1 | 0% | 0% | Clear Liquid |
| Gasoline | 2 | 1% | 0% | Phase separation |
| Gasoline | 3 | 1% | 1% | Clear Liquid |
| Gasoline | 4 | 1% | 0.9% | Clear Liquid |
| Gasoline | 5 | 1% | 0.8% | Clear Liquid |
| Gasoline | 6 | 1% | 0.7% | Clear Liquid |
| Gasoline | 7 | 1% | 0.6% | Clear Liquid |
| Gasoline | 8 | 1% | 0.5% | Phase Separation |
| Gasoline | 9 | 1% | 0.4% | Phase Separation |
| Gasoline | 10 | 1% | 0.3% | Phase Separation |
| Gasoline | 11 | 1% | 0.2% | Phase Separation |
| Gasoline | 12 | 1% | 0.1% | Phase Separation |

After the introduction of each titration the solution was gently stirred for twenty seconds. The resultant effect was left for ten minutes to settle before visible results were recorded.

Example 10.—Gasohol

Consisting of 90% regular unleaded gasoline with 10% deastured ethanol.

| Fuel | No | Water Content | Additive | Comments |
|---|---|---|---|---|
| Gasohol | 1 | 0% | 0% | Clear Liquid |
| Gasohol | 2 | 1% | 0% | Phase separation |
| Gasohol | 3 | 1% | 1% | Clear Liquid |
| Gasohol | 4 | 1% | 0.9% | Clear Liquid |
| Gasohol | 5 | 1% | 0.8% | Clear Liquid |
| Gasohol | 6 | 1% | 0.7% | Clear Liquid |
| Gasohol | 7 | 1% | 0.6% | Clear Liquid |
| Gasohol | 8 | 1% | 0.5% | Clear Liquid |

-continued

| Fuel | No | Water Content | Additive | Comments |
|---|---|---|---|---|
| Gasohol | 9 | 1% | 0.4% | Phase Separation |
| Gasohol | 10 | 1% | 0.3% | Phase Separation |
| Gasohol | 11 | 1% | 0.2% | Phase Separation |
| Gasohol | 12 | 1% | 0.1% | Phase Separation |

After the introduction of each titration the solution was gently stirred for twenty seconds. The resultant effect was left for ten minutes to settle before visible results were recorded.

Example 11.—Diesel

| Fuel | No | Water Content | Additive | Comments |
|---|---|---|---|---|
| Diesel | 1 | 0% | 0% | Clear Liquid |
| Diesel | 2 | 1% | 0% | Phase separation |
| Diesel | 3 | 1% | 1% | Clear Liquid |
| Diesel | 4 | 1% | 0.9% | Clear Liquid |
| Diesel | 5 | 1% | 0.8% | Clear Liquid |
| Diesel | 6 | 1% | 0.7% | Phase Separation |
| Diesel | 7 | 1% | 0.6% | Phase Separation |
| Diesel | 8 | 1% | 0.5% | Phase Separation |
| Diesel | 9 | 1% | 0.4% | Phase Separation |
| Diesel | 10 | 1% | 0.3% | Phase Separation |
| Diesel | 11 | 1% | 0.2% | Phase Separation |
| Diesel | 12 | 1% | 0.1% | Phase Separation |

After the introduction of each titration the solution was gently stirred for twenty seconds. The resultant effect was left for ten minutes to settle before visible results were recorded.

Example 12.—Alternative Gasoline

Consisting of Alcohol and a blend of hydro carbons the majority percentage being alcohol.

| Fuel | No | Water Content | Additive | Comments |
|---|---|---|---|---|
| Alt Gas | 1 | 0% | 0% | Clear Liquid |
| Alt Gas | 2 | 1% | 0% | Phase separation |
| Alt Gas | 3 | 1% | 1% | Clear Liquid |
| Alt Gas | 4 | 1% | 0.9% | Clear Liquid |
| Alt Gas | 5 | 1% | 0.8% | Clear Liquid |
| Alt Gas | 6 | 1% | 0.7% | Clear Liquid |
| Alt Gas | 7 | 1% | 0.6% | Clear Liquid |
| Alt Gas | 8 | 1% | 0.5% | Clear Liquid |
| Alt Gas | 9 | 1% | 0.4% | Clear Liquid |
| Alt Gas | 10 | 1% | 0.3% | Clear Liquid |
| Alt Gas | 11 | 1% | 0.2% | Phase Separation |
| Alt Gas | 12 | 1% | 0.1% | Phase Separation |

After the introduction of each titration the solution was gently stirred for twenty seconds. The resultant effect was left for ten minutes to settle before visible results were recorded.

TESTING—USE

Testing Exhaust Emissions using Indoline Fuel with a Treatment of an Additive known to be a Major Component of Stabilising Fuel.

Introduction

With the phase out of leaded fuel it has become imperative to allow the maximum combustion from the available fuel to maximise performance and minimise pollution by burning as much fuel as possible completely. The tests set out to compare results of treated and un-treated fuel were performed under extreme controls and indoline was used as the carbon balance of this fuel is much more repeatable than un-leaded gasoline.

Experimental Details

The vehicle used was a 1993 California certified Mercury cougar with 26,333 Miles on the odometer. This vehicle is equipped with a 3.8 liter engine with an SFI fuel system and has an inertia weight of 38,875 lbs. This vehicle was supplied by the test laboratories at Roush Laboratiries, Los Angeles, Calif. and was prepared by them for the test.

A chassis dynamometer similar to a Clayton Water Break model was used in accordance with Federal Test Procedure CFR40 also known as the LA4 test.

Firstly the vehicle was pre-conditioned with indoline and this sequence follows these steps:

1/ Drain and fill the tank to 40% capacity with indoline.

2/ Disconnect the vehicles battery to eliminate and misreading by a fuel computer 3/ Drive vehicle for a period of 10 miles on the dynamometer in the specific controlled conditions and allow to soak for a minimum of 12 hours to a maximum of 24 hours.

Specified Control Conditions:

The test of additised fuel against base fuel was run with base fuel first.

The soak time from pre-condition to test was 15 hours, the soak temperature was 76° F. and the barometer H.g. was 29.85.

Additised Control Conditions:

The additised test did not take place until another preconditioning test was complete.

The soak time from pre-condition to test was 20.5 hours, the soak temperature was 76° F. and the barometer H.g. was 29.82.

As the results of interest were potential reduction in Hydrocarbon and Carbon Monoxide emissions a flame ionization detection system was used after collecting the diluted exhaust gases in Tedlar Bags these background bags were analysed within 1 hour of testing so as not to lose any sensitive constituents necessary for a total HC count.

As a more complete combustion was expected the CO detection was in accordance with the LA4–CVS11 test as per recommendations from the California Air Resources Boards.

Test Criteria:

The pre-conditioning consisted of a LA4 test drive lasting 505 seconds plus 873 seconds.

The base fuel test consisted of a cold start for 505 seconds, a cold transient for 873 seconds, a soak for 10 minutes and a hot transient for 505 seconds. Total time=1883 seconds.

The additised fuel test consisted of a cold start for 505 seconds, a cold transient for 873 seconds, a soak for 10 minutes and a hot transient for 505 seconds. Total time=1883 seconds.

Results and Discussion:

| | HC Base Fuel | HC Additised | CO Base Fuel | CO Additised |
|---|---|---|---|---|
| BAG 1 | 53.228 | 47.832 | 212.617 | 160.591 |
| BAG 2 | 0.641 | 0.549 | 24.888 | 22.699 |
| BAG 3 | 4.356 | 2.842 | 39.765 | 14.449 |

All figures in ppm's

| AVERAGE % | HC | CO |
|---|---|---|
| IMPROVEMENT | 27.1 | 39.07 |

As can be seen a reduction in Hydrocarbons and Carbon Monoxide was achieved. Although this was encouraging the fact that the control conditions did not allow for any ambient temperature activities proved the theory that by creating a Monolayer enables the fuel to be delivered in a better condition with less resistance.

The major improvements were on BAG 3. This confirms that the hot transient phase of the test did allow for some temperature difference to enable a co-solvent reaction as well.

The encouragement of these results led up to continue testing but be more precise with the measurements and create a fuel tank as per normal ambient conditions.

The venue for this was the Associated Octel Co. Milton Keynes, England.

TESTING—UK

Generating more miles per gallon of an unleaded reference gasoline additised with a fuel component at a treatment ratio of 1:1,000. The fuel component is a major contributing factor to the stabilisation of fuel. The reduction in $CO_2$ proved the measurement of fuel consumed by weight to be in accordance with out claims.

Introduction

With the phase out of leaded fuel it has become imperative to allow the maximum combustion from the available fuel to maximise performance and minimise pollution by burning as much fuel as possible completely. The tests set out to compare results of treated and un-treated fuel were performed under controls and reference RF-O8 gasoline was used on a Mercedes M111 bench test engine these results were achieved prior to catalytic converter.

Experimental Details

The engine used as a Mercedes M111 and was supplied by the test laboratories at the Associated Octel Co. and details were recorded to N.A.M.A.S. standards.

Firstly the vehicle was pre-conditioned with base fuel and these steps were followed:

1/ Prepare 55 liter drum of PFO8 gasoline and leave external to test shop as per simulation of regular fuel tank.

2/ Clean and polish head of engine and run base test programme from full throttle 4.500 rpm down to idle.

After the base run additise the fuel at 1:1,000 and prepare and test as for base fuel.

Specified control conditions:

The test of additised fuel against base fuel was run with base fuel first.

Additised control conditions:

The additised test did not take place until another preconditioning test was complete.

As the results of interest were potential reduction in Hydrocarbon and Carbon Monoxide emissions a flame ionization detection system was used after collecting the diluted exhaust gases in Tedlar Bags these background bags were analysed within 1 hour of testing so as not to lose any sensitive constituents necessary for a total HC count.

As a more complete combustion was expected the CO detection was in accordance with the N.A.M.A.S. recommendations.

Fuel consumption was measured by weighted control which was fed by the simulated fuel tank and was accurate to 100 ml's.

The results shown are for testing at 2,500 rpm in Aug. 1995 and at a complete retest in November 1995 the results shown are at 1,800 rpm using RF83 fuel which is of a tighter specification than RF08.

RESULTS DATA (MERCEDES MIII Bench Test)
MAXIMUM RESULTS

| | Units - g/Kwh | | | | |
|---|---|---|---|---|---|
| | CO | $CO_2$ | HC | $No_x$ | BSFC |
| 1,800 RPM P.T. Base Fuel | 48.7 | 1620.36 | 9.20 | 10.11 | 550.01 |
| 2,500 RPM P.T. Base Fuel | 41.3 | 1221.6 | 5.4 | 12.99* | 403.78 |
| 1,800 RPM P.T. Additised Fuel | 33.01 | 1179.74 | 7.02 | 5.91 | 381.91 |
| 2,500 RPM P.T. Additised Fuel | 36.12 | 1012.6 | 5.53 | 8.096* | 337.4 |
| | Units - g/h | | | | |
| | CO | $CO_2$ | HC | $No_x$ | MFC |
| 1,800 RPM P.T. Base Fuel | 218.5 | 7225.2 | 41.03 | 45.05 | 2453 |
| 2,500 RPM P.T. Base Fuel | 450.3 | 14267.9 | 63.15 | 349.6 | 4716 |
| 1,800 RPM P.T. Additised Fuel | 147.18 | 5262.8 | 31.22 | 26.31 | 1703.72 |
| 2,500 RPM P.T. Additised Fuel | 416.2 | 11668.6 | 63.76 | 137.26 | 3888 |

*Denotes WOT

RESULTS DATA (MERCEDES MIII Bench Test)
AVERAGE RESULTS

| | Units - g/Kwh | | | | |
|---|---|---|---|---|---|
| | CO | $CO_2$ | HC | $No_x$ | BSFC |
| 1,800 RPM P.T. Base Fuel | 48.1 | 1565.8 | 8.81 | 9.15 | 527.5 |
| 1,800 RPM P.T. Additised Fuel | 37.2 | 1285.3 | 7.81 | 7.14 | 423.59 |
| 2,500 RPM P.T. Base Fuel | 40.2 | 1154.9 | 5.465 | 13.045 | 384.74 |
| 2,500 RPM P.T. Additised Fuel | 36.13 | 1012.6 | 4.91 | 8.10 | 337.46 |
| | Units - g/h | | | | |
| | CO | $CO_2$ | HC | $No_x$ | MFC |
| 1,800 RPM P.T. Base Fuel | 214.53 | 6967.81 | 39.20 | 40.72 | 2347.38 |
| 1,800 RPM P.T. Additesed Fuel | 165.54 | 5719.59 | 34.75 | 31.77 | 1884.58 |
| 2,500 RPM P.T. Base Fuel | 462.98 | 13300.98 | 62.94 | 150.24 | 4431.05 |

-continued

RESULTS DATA (MERCEDES MIII Bench Test)
AVERAGE RESULTS

| | | | | | |
|---|---|---|---|---|---|
| 2,500 RPM P.T. Additised Fuel | 415.99 | 11661.61 | 56.09 | 93.24 | 3885.84 |

TESTING—UK DIESEL

Due to the success the above results we took a diesel vehicle at random and used a dosage of 1:1,000 for a before and after smoke test.

The results are extremely encouraging and once again confirm the two aspects of the invention with the treatment ratio at 1:1,000 the predominant force is monolayer construction.

The two graphs show overall percentage black smoke reduction of 66% and using a smoke unit conversion chart the particulate matter reduction equals 71.7%.

DIESEL TEST

Vehicle: FORD "Fiesta" Diesel

Test: As per M.O.T. Standards

Criteria: Exhaust Emissions Diesel, Pass Below 2–5 $m^{-1}$ (k)

Method: Pre-Condition (Oil Temperature Check)

Fast Idle Test N° 1

Fast Idle Test N° 2

Fast Idle Test N° 3

Fast Idle Test N° 4

Idle up to Governor "Cuts In" then reading is taken Computer decides how many readings necessary prior to averaging "k"

What is claimed is:

1. A fuel composition comprising in combination fuel and a minor proportion of a fuel additive wherein the additive comprises fatty acid diethanolamide, an alcohol ethoxylate and an ethoxylate of a fatty acid, the degree of ethoxylation being selected so that a stable fuel composition is formed wherein the amounts by volume of fatty acid diethanolamide, and ethoxylate fatty acid are substantially the same.

2. A fuel composition comprising in combination fuel and a minor proportion of a fuel additive wherein the additive comprises a fatty acid diethanolamide, an alcohol ethoxylate and an ethoxylate of a fatty acid, the degree of ethoxylate being selected so that a stable fuel composition is formed wherein the ethoxylate of the fatty acid makes up about 25% by volume of the additive.

3. A fuel composition according to claim 1, wherein the additive is present in an additive to fuel weight ratio of about 1:1000.

4. A fuel composition according to claim 1, wherein the additive is a non-ionic surfactant.

5. A fuel composition according to claim 1, wherein the additive has an HLB value of about 8.

6. A fuel composition according to claim 1, wherein the fuel is an alcohol and the additive has an HLB value of about 8.

7. A fuel composition according to claim 1, wherein the ingredients of the additive composition are present in a total additive to fuel ratio of about 0.5 to 1:1,000 by volume.

8. A fuel composition according to claim 9, wherein the additive to fuel ratio is about 1:1000 by volume.

9. A fuel composition according to claim 1, wherein the ingredients of the additive composition are present in a total additive to fuel ratio of about 1:1200.

10. A fuel composition according to claim 1, comprising a light weight fraction fuel and wherein the additive is miscible with the fuel selected to solubilise the fuel and any water present to form a clear homogenous composition.

11. A fuel composition according to claim 10, wherein the light fraction is an oil.

12. A fuel composition according to claim 10, wherein the light fraction is alcohol.

13. A fuel composition according to claim 10, wherein the light fraction fuel is a C5 to C15 hydrocarbon.

14. A fuel composition according to claim 10, wherein the light fraction fuel is a C10 to C20 hydrocarbon.

15. A fuel composition according to claim 10, wherein the light fraction fuel is a C5 to C20 hydrocarbon.

16. A fuel composition according to claim 10, wherein the light fraction is an aromatic hydrocarbon.

17. A fuel composition according to claim 10, wherein the light fraction fuel is a C10 to C25 hydrocarbon.

18. A fuel composition according to claim 10, wherein the light fraction fuel is a C15 to C30 hydrocarbon.

19. A fuel composition according to claim 10, wherein the light fraction fuel is a C5 to C30 hydrocarbon.

20. A method of running an engine adapted to use an alcohol-based fuel, comprising adding to the fuel a miscible additive according to claim 1 selected to solubilise the fuel and the additive so eliminating the deposit of by-products formed during the combustion of the fuel.

21. A method according to claim 20, wherein the by-product is iron-formate.

22. A method according to claim 20, wherein the by-product is aldehydes.

23. A method according to claim 20, wherein the by-product is per-acids.

24. A method according to claim 20, wherein the by-products is per-oxides.

25. A method according to claim 20, wherein the by-product is reduced and that by-product is carbon monoxide.

26. A method according to claim 20, wherein the by-product is reduced and that by-product is a hydrocarbon.

27. A method according to claim 20, wherein the by-product is reduced and that by-product is NOx.

28. A method according to claim 20, wherein the by-product is reduced and that by-product is $CO_2$.

29. A method according to claim 20, wherein the by-product is reduced and that by-product is exhaust emissions.

30. A fuel composition according to claim 1, wherein the fuel is Diesel.

31. A fuel composition according to claim 1, wherein the fuel is Diesel and alcohol.

32. A fuel composition according to claim 1, wherein the fuel is Diesel and kerosene.

33. A fuel composition according to claim 1, wherein the fuel is Diesel and a C5 to C40 hydrocarbon.

34. A fuel composition according to claim 1, wherein the fuel is Diesel and a lighter fraction.

35. A fuel composition comprising in combination fuel and a fuel additive wherein the additive comprises a minor proportion of each of a fatty acid diethanolamide, an alcohol ethoxylate and an ethoxylate of a fatty acid, the degree of ethoxylation being selected so that a stable fuel composition is formed, wherein the additive is present in an additive to fuel weight ratio of 1:100.

36. A fuel composition according to claim 35, wherein the additive is present in an additive to fuel weight ratio of 1:200.

37. A fuel composition according to claim 35, wherein the additive is present in an additive to fuel weight ratio of 1:300.

38. A fuel composition according to claim 35, wherein the additive is present in an additive to fuel weight ratio of 1:400.

39. A fuel composition according to claim 35, wherein the additive is present in a weight ratio of 1:500.

40. A fuel composition comprising in combination fuel and a fuel additive wherein the additive comprises a minor proportion of each of a fatty acid diethanolamide, an alcohol ethoxylate and an ethoxylate of a fatty acid, the degree of ethoxylation being selected so that a stable fuel composition is formed, wherein the additive is present in an additive to fuel weight ratio of from 1:500 to 1:1000.

41. A fuel composition according to claim 1, wherein the degree of ethoxylation does not inhibit the surface tension.

42. A fuel composition according to claim 1, wherein a monolayer is created.

43. A fuel composition according to claim 2, wherein the additive is present in an additive to fuel weight ratio of about 1:1000.

44. A fuel composition according to claim 2, wherein the additive is a non-ionic surfactant.

45. A fuel composition according to claim 2, wherein the additive has an HLB value of about 8.

46. A fuel composition according to claim 2, wherein the fuel is an alcohol and the additive has an HLB value of about 8.

47. A fuel composition according to claim 2, wherein the ingredients of the additive composition are present in a total additive to fuel ratio of about 0.5 to 1:1,000 by volume.

48. A fuel composition according to claim 2, comprising a light weight fraction fuel and wherein the additive is miscible with the fuel selected to solubilise the fuel and any water present to form a clear homogenous composition.

49. A fuel composition according to claim 48, wherein the light fraction is selected from the group consisting of gasoline, alcohol, a C5 to C15 hydrocarbon, a C10 to C20 hydrocarbons, a C5 to C20 hydrocarbon, an aromatic hydrocarbon, a C10 to C25 hydrocarbons, a C15 to C30 hydrocarbon, and C5 to C10 hydrocarbon.

50. A method of running an engine adapted to use an alcohol-based fuel, comprising adding to the fuel a miscible additive according to claim 2 selected to solubilise the fuel and the additive so eliminating the deposit of by-products formed during the combustion of the fuel.

51. A method according to claim 50, wherein the by-product is selected from the group consisting of iron-formate, aldehydes, per-acids and per-oxides.

52. A method according to claim 50, wherein the by-product is reduced and that by-product is selected from the group consisting of carbon monoxide, hydrocarbon, NOx, $CO_2$, and exhaust emissions.

53. A fuel composition according to claim 2, wherein the fuel is selected from the group consisting of Diesel, Diesel and alcohol, Diesel and kerosene, Diesel and a C5 to C40 hydrocarbon, Diesel and a lighter fraction, and Diesel and co-solvent.

54. A fuel composition according to claim 2, wherein the composition is present such that an oleophobic relationship is formed at an inlet manifold.

55. A fuel composition according to claim 1, wherein surface tension liquid to liquid, liquid to solid and liquid to air changes.

* * * * *